US007124671B2

(12) United States Patent
Williams et al.

(10) Patent No.: US 7,124,671 B2
(45) Date of Patent: Oct. 24, 2006

(54) METHOD AND DEVICE FOR REDUCING WEB BREAKAGE IN A WEB CUTTER

(75) Inventors: Daniel J Williams, Woodbury, CT (US); Gregory P Skinger, Southbury, CT (US); John W Sussmeier, Cold Springs, NY (US)

(73) Assignee: Pitney Bowes Inc., Stamford, CT (US)

( * ) Notice: Subject to any disclaimer, the term of this patent is extended or adjusted under 35 U.S.C. 154(b) by 344 days.

(21) Appl. No.: 10/431,237

(22) Filed: May 6, 2003

(65) Prior Publication Data

US 2004/0221700 A1 Nov. 11, 2004

(51) Int. Cl.
*B23Q 15/00* (2006.01)
*B26D 5/00* (2006.01)
*B65H 20/00* (2006.01)

(52) U.S. Cl. ..... 83/74; 83/76; 83/367; 226/24; 226/111

(58) Field of Classification Search ..... 83/13, 83/74, 76, 367, 732, 410, 416, 236; 226/111, 226/118.1, 115, 117, 29, 32, 33, 24, 122, 226/123
See application file for complete search history.

(56) References Cited

U.S. PATENT DOCUMENTS 4,150,261 A * 4/1979 Mason ..... 369/25.01
4,272,185 A * 6/1981 Arai et al. ..... 355/28
4,593,893 A * 6/1986 Suter ..... 270/52.12
4,648,540 A * 3/1987 Steidel ..... 226/111
5,392,977 A 2/1995 Kato
5,765,460 A * 6/1998 Wathieu ..... 83/37
5,768,959 A 6/1998 Lorenzo
5,833,105 A 11/1998 Stuber
5,979,732 A * 11/1999 Crowley et al. ..... 226/31
6,125,730 A * 10/2000 Jacques ..... 83/408

FOREIGN PATENT DOCUMENTS

DE 10011006 A 9/2001

* cited by examiner

*Primary Examiner*—Boyer D. Ashley
*Assistant Examiner*—Omar Flores Sánchez
(74) *Attorney, Agent, or Firm*—Michael J. Cummings; Steven J. Shapiro; Angelo N. Chaclas

(57) ABSTRACT

In a web cutter where a blade is used to cut a continuous paper web into sheets, a tractor is used to move the web past the blade for cutting. The tractor operates in a start-and-stop cycle so that the web is temporarily stopped to allow the blade to lower and shear the web. The tractor accelerates in the next cycle to move another length of paper downstream from the blade. A high-speed cutter requires high acceleration of the tractor. This acceleration force causes the web to whip up uncontrollably, causing the web to break or wrinkle. To reduce the web breakage, a moving mechanism positioned upstream from the tractor and operate a second motion cycle is used to move the web toward the tractor such that a loop of paper is formed upstream of the tractor, thereby reducing the whipping action of the web.

21 Claims, 7 Drawing Sheets

METHOD AND DEVICE FOR REDUCING WEB BREAKAGE IN A WEB CUTTER

FIELD OF THE INVENTION

The present invention relates generally to a sheet accumulating system and, more particularly, to a continuous web cutter.

BACKGROUND OF THE INVENTION

Continuous web cutters are known in the art. Typically, a continuous web cutter is used to cut a continuous web of material into cut sheets, and provide the cut sheets to a sheet accumulator, where the accumulated sheets are moved to an insertion station in a mass mailing inserting system. In a typical web cutter, a continuous web of material with sprocket holes on both side of the web is fed from a fanfold stack into the web cutter. The web cutter has a tractor with pins or a pair of moving belts with sprockets to move the web toward a guillotine cutting module for cutting the web cross-wise into separate sheets. Perforations are provided on each side of the web so that the sprocket hole sections of the web can be removed from the sheets prior to moving the cut sheets to other components of the mailing inserting system. In particular, some continuous web cutters are used to feed two webs of material linked by a center perforation. In the cutter, a splitter is used to split the linked webs into two separate web portions before the linked webs are simultaneously cut by the cutting module into two cut sheets.

In a feed cycle, the paper is advanced past the blade of the guillotine cutting module by a distance equal to the length of the cut sheet and is stopped. In a cut cycle, the blade lowers to shear off the sheet of paper, and then withdraws from the paper. As soon as the blade withdraws from the paper path, the next feed cycle begins. The feed and cut cycles are carried out in such an alternate fashion over the entire operation.

In some web cutters, it is desirable to achieve a cutting rate of 25,000 cuts per hour or more, for example. This means that the web cutter has a feed/cut cycle of 144 ms. Typically the length of the cut sheet is 11 inches (27.94 cm). If the time to complete a cut cycle is about 34 ms, then the total time in a feed cycle is 110 ms. This means that the web must be accelerated from a stop position to a predetermined velocity and then decelerated in order to stop again within 110 ms. The acceleration and deceleration action of the tractor causes the paper web immediately upstream of the tractor to whip up and down uncontrollably. If the whipping motion is severe, the web may break. As the cutting rate increases, the problem becomes more acute.

Lorenzo (U.S. Pat. No. 5,768,959) discloses a web cutter wherein two separate modules are used to take in a web from upstream: a slitter module for slitting the web into two web portions so as to allow a cutter module to separately cut the web portions into sheets. In order to coordinate the movement of the web portions between the slitter module and the cutter module, two parallel paper loops are provided between the two modules.

While this approach helps reduce the breakage of the web, the loops are too large. Moving such a large loop might still cause the web to tear because of the inertia and whip when the web cutter operates at a high cutting rate.

It is advantageous and desirable to provide a method and device for further reducing the whipping motion of the web paper immediately upstream of the tractor and the tension in the web due to acceleration of the tractor so as to avoid breakage of the web.

SUMMARY OF THE INVENTION

The present invention uses one or more control loops upstream from the tractor of a web cutter to reduce the whipping or snapping action of the web.

According to the first aspect of the present invention, a method is provided for further reducing breaking in a paper web when the web is moved into a web cutter from an upstream source, wherein the web cutter comprises:

a cutting mechanism for cutting the web into sheets, and a first moving mechanism for moving the web into the web cutter, wherein the first moving mechanism operates in a start-and-stop motion cycle, the motion cycle having a stop period to allow the cutting mechanism to cut a sheet from the web, and an acceleration period during which the first moving mechanism accelerates from a stationary state to a predetermined velocity at a cutter acceleration in order to move a length of the web downstream from the cutting mechanism, and a deceleration period during which the first moving mechanism decelerates from the predetermined velocity at a cutter deceleration to the stop period. The method comprises the steps of:

disposing a second moving mechanism upstream from the first moving mechanism for moving the web toward the first moving mechanism to form a partial loop upstream from the first moving mechanism so as to allow the first moving mechanism to move the web toward the cutting mechanism via the partial loop, and operating the second moving mechanism in a further motion cycle in coordination with the start-and-stop motion cycle and having a second acceleration less than the cutter acceleration and a second deceleration less than the cutter deceleration.

Preferably, the first moving mechanism moves the web into the web cutter along a first plane, and the second moving mechanism moves the web toward the first moving mechanism along a second plane different from the first plane. The first plane is a horizontal plane, and the second moving mechanism is disposed below the first plane so as to move the web toward the first moving mechanism from a point below the first plane.

Preferably, the second plane is substantially a vertical plane.

Advantageously, the further motion cycle having a further starting point substantially coincident with a starting point of the start-and-stop motion cycle.

Preferably, the second moving mechanism has a minimum speed when it is at the further starting point. The minimum speed can be zero or greater than zero.

Advantageously, substantially all of the loop of paper upstream from the first moving mechanism is used up after the acceleration period of the second moving mechanism.

According to the present invention, the first moving mechanism moves the web more than the second moving mechanism by a length difference prior to the deceleration period, and the loop is greater than or substantially equal to the length difference.

Advantageously, the method further comprises the step of disposing a third moving mechanism upstream from the second moving mechanism for moving the web toward the second moving mechanism, such that a further partial loop of paper is formed between the second moving mechanism and the third moving mechanism so as to allow the second moving mechanism to move the web toward the first moving mechanism via the further partial loop.

According to the second aspect of the present invention, a web cutting system is provided for moving a web of paper from an upstream paper source and for cutting the web into sheets. The web cutting system comprises:

a cutting mechanism;

a first moving mechanism, positioned upstream from the cutting mechanism, for moving the web of paper past the cutting mechanism, wherein the first moving mechanism operates in a stop-and-start motion cycle, the motion cycle having a stop period to allow the cutting mechanism to cut a sheet of the web, an acceleration from which the first moving mechanism accelerates from a stationary state to a predetermined velocity at a cutter acceleration in order to move a length of the web downstream from the cutting mechanism for cutting, and a deceleration period during which the first moving mechanism decelerates from the predetermined velocity at a cutter deceleration to the stop period; and a second moving mechanism positioned upstream from the first moving for moving the web toward the first moving mechanism to form a partial loop of paper upstream from the first moving mechanism so as to allow the first moving mechanism to move the web via the partial loop, wherein the second moving mechanism operates in a further motion cycle in coordination with the start-and-stop motion cycle, wherein the further motion cycles has a second acceleration less than the cutter acceleration and a second deceleration less than the cutter deceleration.

Advantageously, the web cutting system further comprises:

a third moving mechanism positioned between the second moving mechanism and the upstream paper source for moving the web toward the second moving mechanism, such that a further partial loop of paper is formed between the second moving mechanism and the third moving mechanism so as to allow the second moving mechanism to move the web toward the first moving mechanism from the further partial loop.

The present invention will become apparent upon reading the description taken in conjunction with FIGS. 1*a* to 6.

BEST MODE TO CARRY OUT THE INVENTION

Figure 1A:
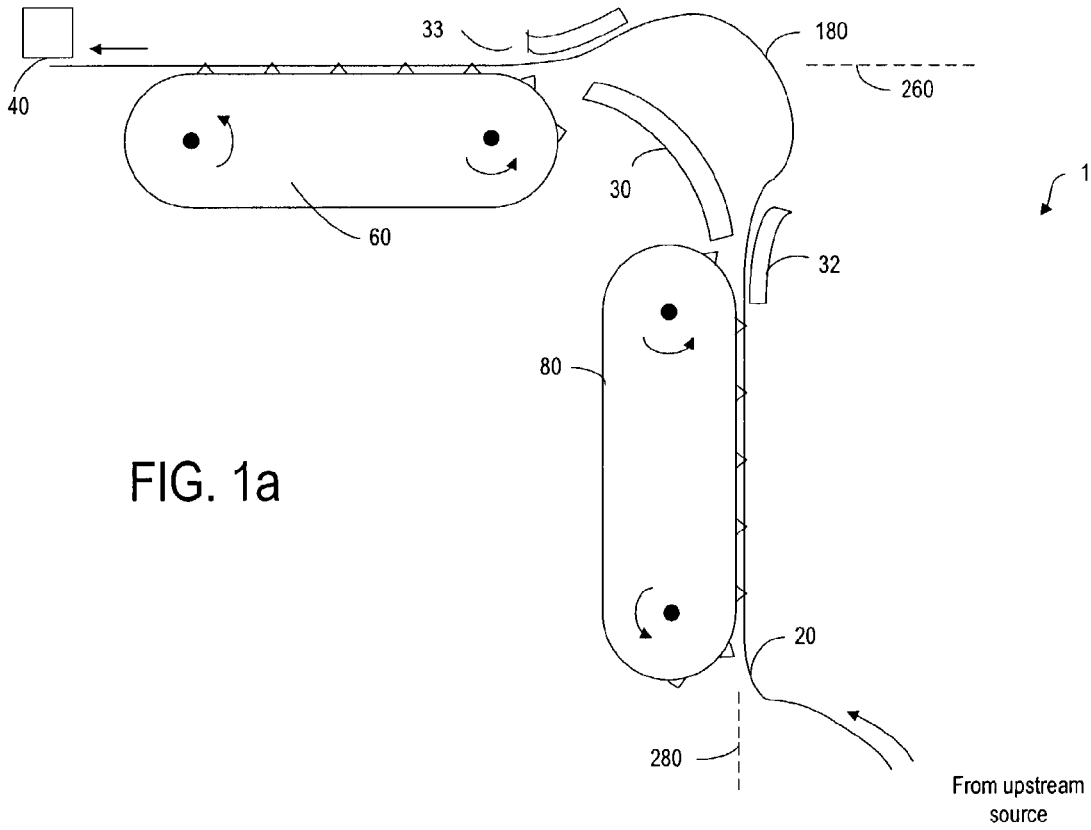
FIG. 1*a* is a schematic representation illustrating a preferred embodiment of the present invention at the start of a feeding cycle.
Figure 1B:
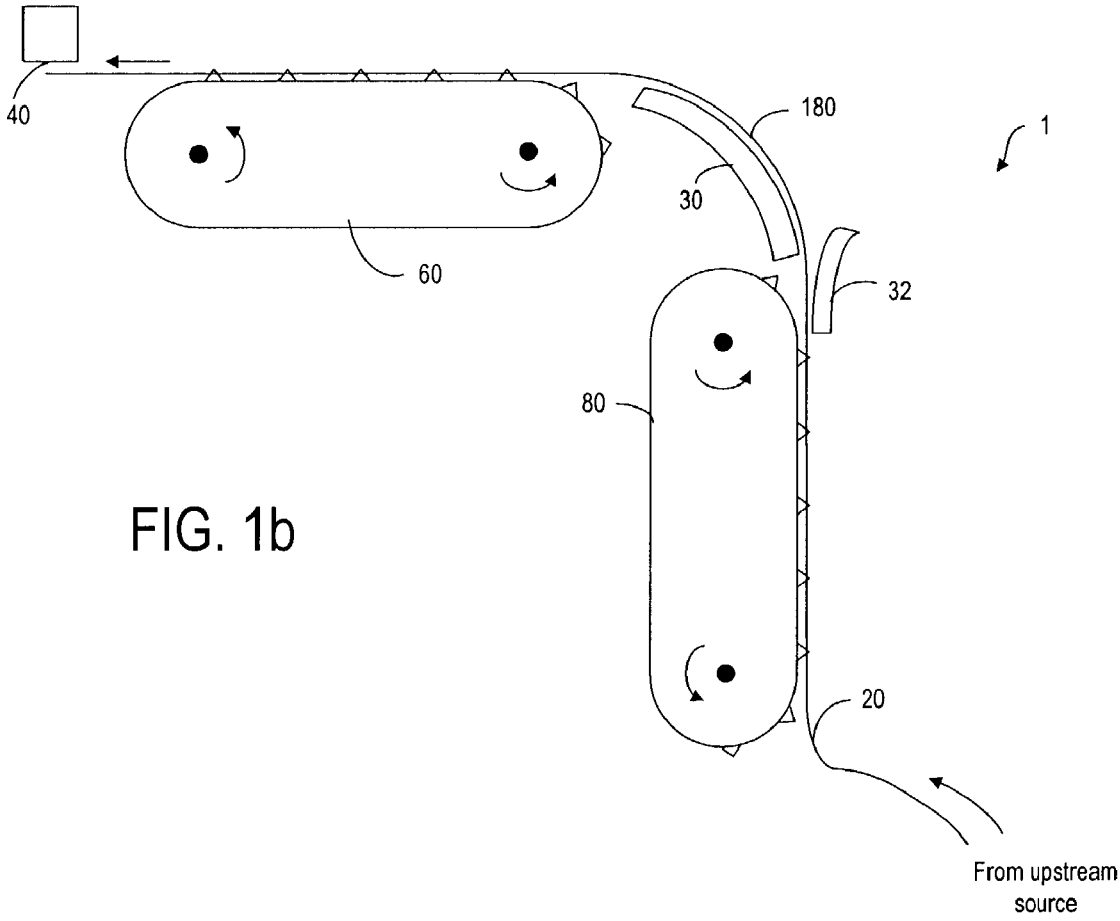
FIG. 1*b* is a schematic representation illustrating the preferred embodiment at the end of the feeding cycle.

The method of web control, according to the present invention, is illustrated in FIGS. 1*a* and 1*b*. As shown in FIGS. 1*a* and 1*b*, the web cutter 1 comprises a primary tractor 60 and a secondary tractor 80 for moving the web 20 from an upstream source to a cutter 40. The method can effectively reduce the inertia acting on the web paper immediately upstream from the primary tractor 60. The reduction in inertia is achieved by disposing the secondary tractor 80 upstream from the primary tractor 60, forming a partial paper loop 180 between the primary tractor 60 and the secondary tractor 80. Furthermore, the second tractor 80 is oriented such that the inertia acting on the loop 180 can be effectively reduced.

In particular, when the primary tractor 60 moves the web in a direction substantially in a horizontal plane 260, the secondary tractor 80 is oriented such that it moves the web in a direction substantially in a vertical plane 280 from a point below the horizontal plane 260. As such, the web is pushed upward when it enters the loop 180. As shown in FIGS. 1*a* and 1*b* a support deck 30 is used to support the loop 180 and a paper guide 32 is used to guide the web when the loop 180 is formed. A further paper guide 33 may be used to guide the paper path on the on the opposite side of the loop 180 from guide 32.

It is preferred that the control loop 180 be small so as to reduce the inertia acting on the web. In order to achieve a small control loop 180, both the primary tractor 60 and the secondary tractor 80 are set in motion in a coordinated way. In particular, both the primary tractor 60 and the secondary tractor 80 are designed to accelerate and decelerated in a related operation cycle. Because only the primary tractor 60 must stop to allow for the cutting cycle, the secondary tractor 80 can accelerate and decelerate differently from the primary tractor 60. Thus, while the primary tractor 60 operates at full acceleration and advances the web 20 as quickly as possible, the secondary tractor 80 operates at a lower acceleration rate. This lower acceleration rate reduces the breakage of the web as the web paper is pulled by the secondary tractor 80 from the upstream source. At the same time, because the paper at the control loop 180 is moved by the secondary tractor 80 toward the primary tractor 60, the stop-and-start motion of the primary tractor 60 does not produce as severe a pull on the paper.

Figure 2:
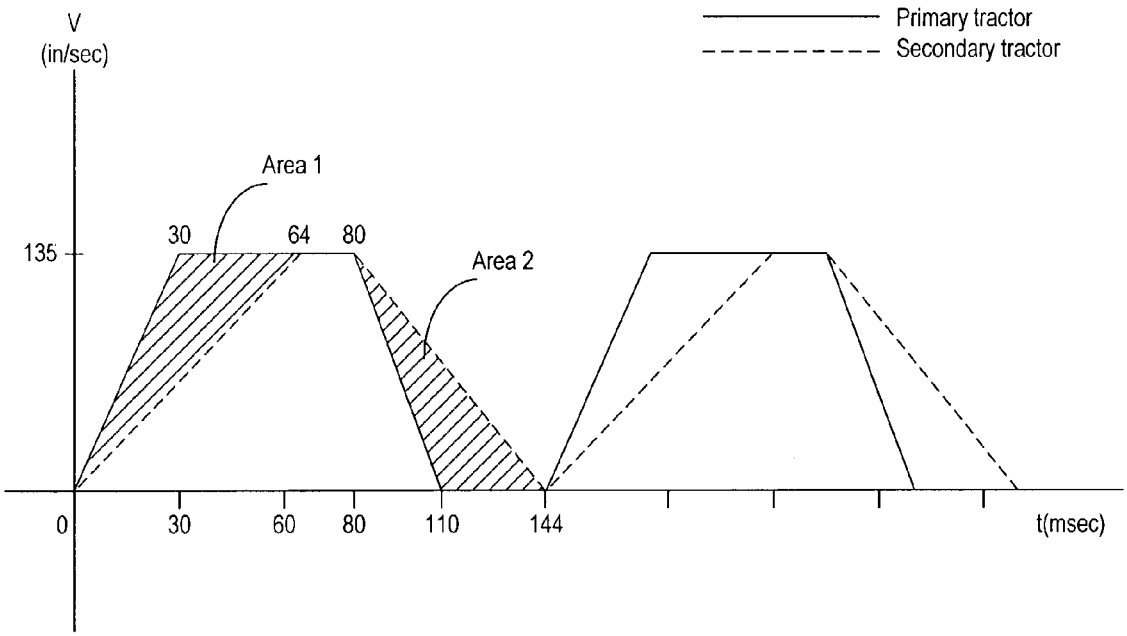
FIG. 2 is a timing diagram showing the velocity profile of the trackers for meeting a certain cutting rate, according to the present invention.

An exemplary velocity profile of the primary tractor 60 and that of the secondary tractor 80 are shown in FIG. 2. In this particular profile, the acceleration and deceleration rate of the secondary tractor is about half of the acceleration and deceleration rate of the primary tractor. As shown, when the primary tractor 60 stops for about 34 ms during the cut cycle, the secondary tractor 70 is still in motion—although it is decelerating. The amount of excess paper in the control loop 180 increases until the secondary tractor 80 stops. The amount of excess paper in the control loop 180 is largest between the time the secondary tractor stops and the start of both tractor cycles, as shown in FIG. 1*a*. When the next feed cycle starts, the primary tractor 60 moves the paper faster than the secondary tractor 80 does, until both tractors reach the same velocity (see FIG. 2). At that point, the control loop 180 is smallest, as shown in FIG. 1*b*.

For example, if the primary tractor 60 accelerates from 0 to 135 in/sec from t=0 to 30 ms and the secondary tractor 80 accelerates from 0 to 135 in/sec from t=0 to 64 ms, then the reduction in paper length in the control loop 180 is given by Area 1, or $$(1/2)(135\text{ in/sec})(0.03\text{ sec})+(135\text{ in/sec})(0.034\text{ sec})-(1/2)(135\text{ in/sec})(0.064\text{ sec})==2.295\text{ in}$$

This means that there must be at least 2.295 inches of paper in the control loop 180 before a feed/cut cycle begins. In order to maintain the same loop situation, Area 2 must be equal to Area 1, as shown in FIG. 2. Accordingly, if the primary tractor 60 starts to decelerate at t=60 ms until it stops at t=110 ms, the secondary tractor 80 should decelerate from t=80 ms to t=144 ms.

With this motion profile, the acceleration rate of the primary tractor 60 is given by $$a_{t1}=135\text{ (in/}s\text{)}/0.03\ s=4500\text{ (in/}s^2\text{)}=11.6\text{ g},$$

and the acceleration rate of the secondary tractor 80 is given by $$a_{t2}=135\text{ (in/}s\text{)}/0.064\ s=2109\text{ (in/}s^2\text{)}=5.44\text{ g}$$

where g is acceleration of gravity.

With the motion profiles, as shown in FIG. 2, it is possible to form a control loop having a maximum excess paper amount of about 2.295 in. It is not possible to have such a small control loop if the secondary tractor operates at a constant velocity. If the secondary tractor operates at a constant velocity while the primary tractor operates a stop-and-start motion cycle as shown in FIG. 2, the paper loop would be at least 5.087 in.

Accordingly, the required minimum amount of paper in the loop 180 (FIG. 1*a*) when the primary tractor 60 starts to move is small. This means that the present invention, by using the coordinated movement of the secondary tractor 80 alone, substantially reduces the mass of the control loop.

Figure 3:
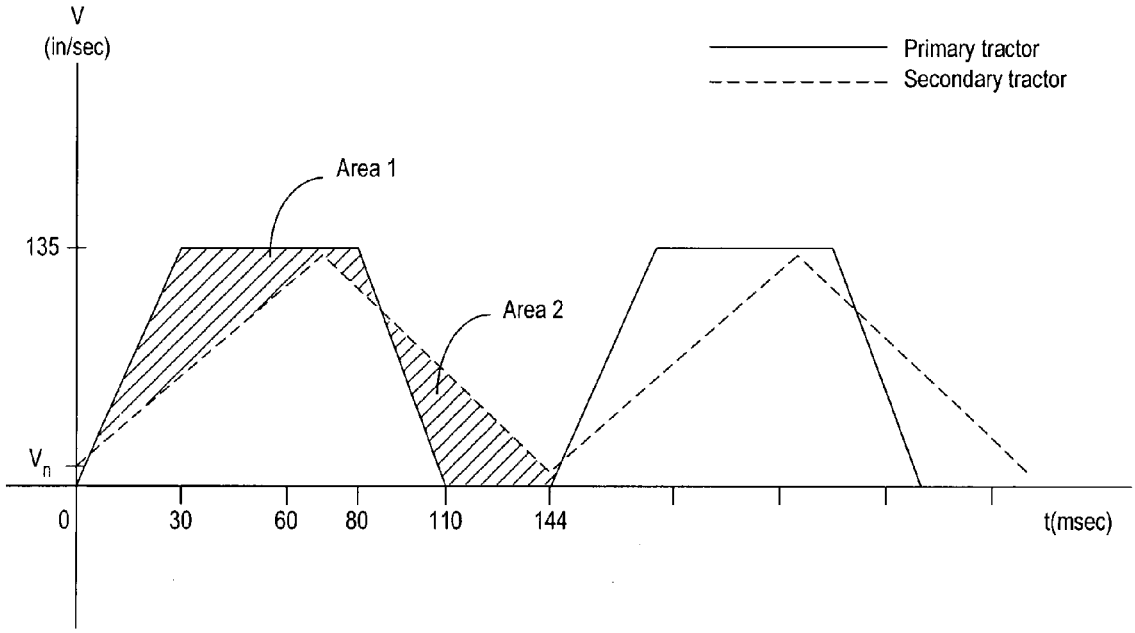
FIG. 3 is a timing diagram showing the velocity profile of the trackers for meeting another cutting rate, according to the present invention.

It should be noted that the secondary tractor 80 is not required to stop between cycles. For example, the secondary tractor 80 can accelerate and decelerate, yet maintain a minimum velocity Vn, as shown in FIG. 3. However, the required minimum amount of paper in the loop 180 (when the primary tractor 60 starts to move) will increase as a function of Vn.

Figure 4:
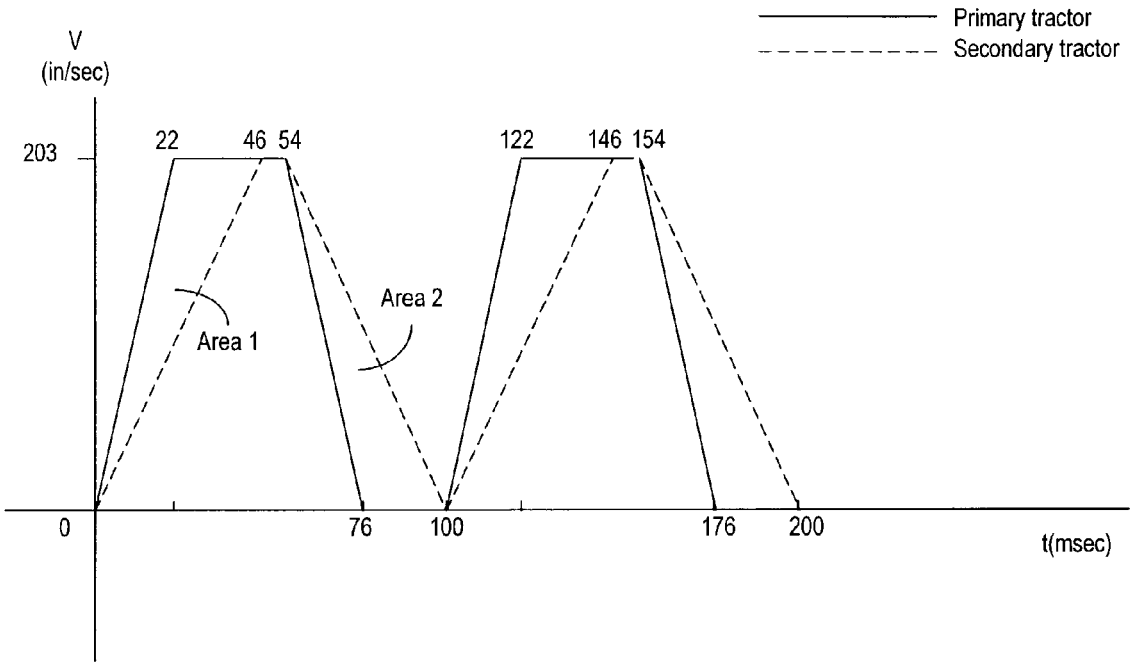
FIG. 4 is a timing diagram showing an alternative motion file of the second tractor.

If it is desirable to have a maximum of 36,000 cuts per hour with a cut cycle of 24 ms, the velocity profile of the primary tractor and that of the secondary tractor are shown in FIG. 4. With the motion profile as shown in FIG. 4, we have $$\begin{aligned}\text{Area 1} &= \text{Area 2}\\ &= (1/2)(203\text{ in/s})(0.022\text{ s})+(203\text{ in/s})(0.024\text{ s})-\\ &\quad (1/2)(203\text{ in/s})(0.046\text{ s})\\ &= 2.436\text{ in}\end{aligned}$$

$$a_{t1}=203\text{ (in/}s\text{)}/0.022\ s=9227\text{ (in/}s^2\text{)}=23.8\text{ g},$$

$$a_{t2}=203\text{ (in/}s\text{)}/0.046\ s=4413\text{ (in/}s^2\text{)}=11.4\text{ g}$$

With the velocity profile, as shown in FIGS. 2 and 4, the feed cycle starts with the primary tractor at full acceleration and the secondary tractor at a lower acceleration rate.

With the motion profiles as shown in FIGS. 2 and 4, the minimum size of the loop is that of Area 1 (or Area 2). As such, substantially all of the loop between the primary tractor and the secondary tractor is used up after the acceleration period of the second moving mechanism. In practice, the loop can be slightly greater than the minimum size to accommodate the variation in the movement mechanisms in the web cutter. Nevertheless, it is preferred that the primary tractor and the secondary tractor are spaced a maximum of one sheet length apart. Furthermore, as the motion profiles in FIGS. 2 and 4 suggest, the secondary tractor decelerates and then accelerates between adjacent without pausing. However, it is possible that the secondary tractor stops for a very short period of time between cycles.

By placing the secondary tractor 80 orthogonal to the primary tractor 60, control of loop formation is enhanced by the bend in the paper path. Thus, as shown in FIGS. 1*a* and 1*b*, inertia will be further reduced in the paper loop due to the normal (perpendicular) acceleration as the paper changes direction from vertical to horizontal. There will also be tension in the web due to the reduction in velocity differential between the primary tractor and the secondary tractor during the acceleration portion of the cycle. The tension in the web helps control the paper with a small control loop. Furthermore, the stiffness of the paper will also help control the paper in reducing the whipping motion and preventing the paper from wrinkling during movement. With a small control loop, the effect of paper stiffness on paper control becomes more substantial. The small control loop will allow shorter feed cycles with high acceleration at the primary tractor and a lower acceleration rate at the secondary tractor. Low acceleration at the secondary tractor reduces the whipping motion of the web upstream.

It is preferred that the primary and the secondary tractors are driven by separate and independent motors. However, these motors will be controlled in a coordinated way, as shown in FIGS. 2 to 4. With the control loop ahead of the primary tractor, the primary motor (the one that drives the primary tractor) does not need to move as much paper mass as when there is no control loop. Because the work in moving the paper web is shared by two motors, the primary motor can be smaller and have lower inertia. As such, the primary motor is capable of operating at a higher acceleration rate, resulting in a shorter feed cycle. As for the motor that drives the secondary tractor, it is less sensitive to inertia because the secondary tractor is operating at lower acceleration during the feed cycle.

Figure 5:
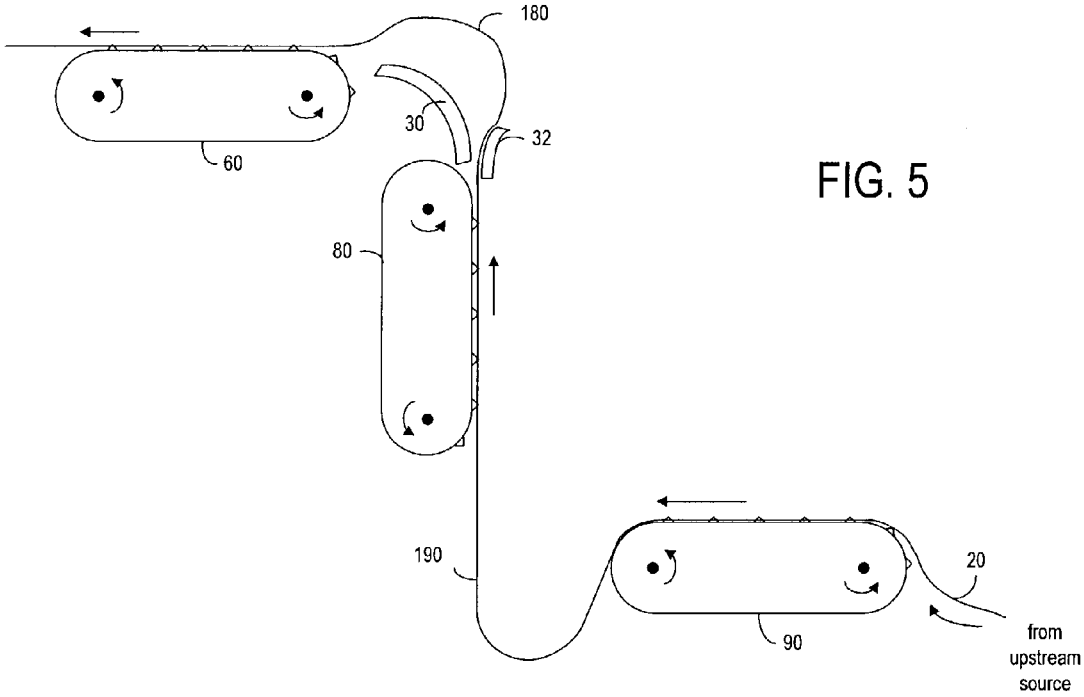
FIG. 5 is a schematic representation illustrating an alternative method of web control, according to the present invention.

It is also possible to have more than one control loop between the upstream source and the primary tractor 60. As shown in FIG. 5, a third or tertiary tractor 90 is disposed upstream from the secondary tractor 80 to move the web 20 toward the secondary tractor 80, such that a second control loop 190 is formed between the secondary tractor 80 and the tertiary tractor 90. Because of the position of the tertiary tractor 90 relative to the secondary tractor 80, the web immediately downstream from the tertiary tractor 80 is likely to move downward. Thus, the second control loop 190 is likely to be formed vertically and downward. It is preferred that the acceleration rate of the tertiary tractor 90 be lower than that of the secondary tractor 80.

Figure 6:
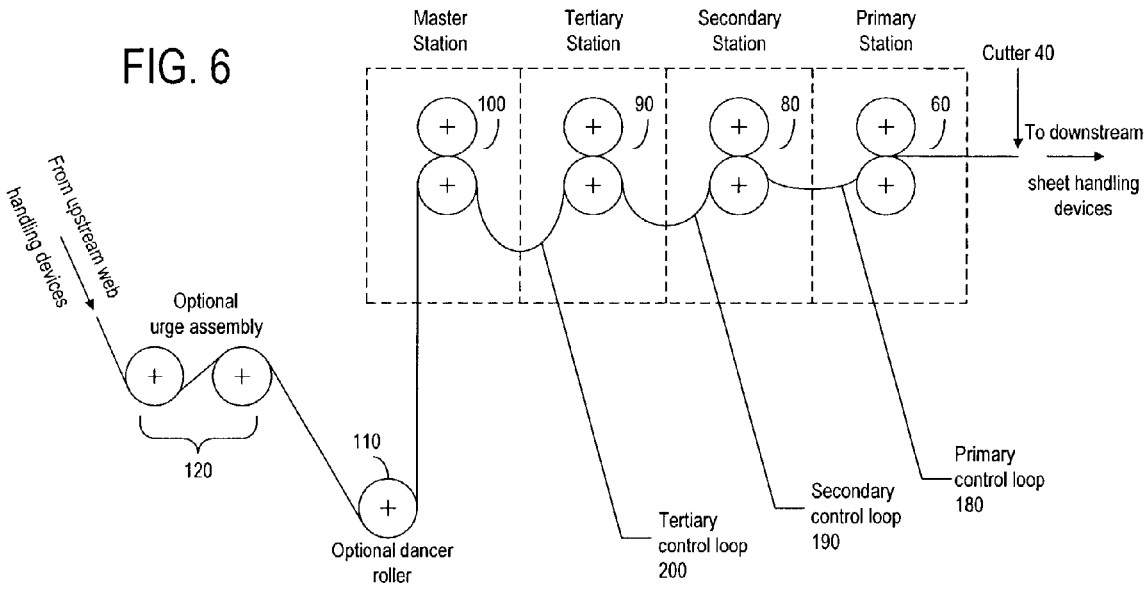
FIG. 6 is a schematic representation illustrating yet another method of web control, according to the present invention.

It should be noted that the number of control loops can be three or more. As shown in FIG. 6, a tertiary control loop 200 is formed between the tertiary tractor 90 and a master station 100. Furthermore, an optional urge assembly 120 and a dancer roller 110 are used to keep the paper upstream from the master station 90 taut.

The web moving mechanisms for moving the paper web into the web cutter have been described as tractors. However, it is also possible to use wheels and rollers to move the web. This is known in the industry as pinless tractors. With wheels and rollers, it is not necessary to provide sprocket holes of the web.

Although the invention has been described with respect to a preferred embodiment thereof, it will be understood by those skilled in the art that the foregoing and various other changes, omissions and deviations in the form and detail thereof may be made without departing from the scope of this invention.

What is claimed is:

1. A method for reducing breakage in a paper web when the web is moved into a web cutter from an upstream source, said method comprising the steps of providing a cutting mechanism for cutting the web into sheets, and providing a first moving mechanism for moving the web into the web cutter, wherein the first moving mechanism operates in a start-and-stop motion cycle, the motion cycle having a stop period to allow the cutting mechanism to cut a sheet from the web, an acceleration period during which the first moving mechanism accelerates from a stationary state to a predetermined velocity at a cutter acceleration in order to move a length of the web downstream from the cutting mechanism, and a deceleration period during which the first moving mechanism decelerates from the predetermined velocity at a cutter deceleration to the stop period, said method comprising the steps of:

disposing a second moving mechanism upstream from the first moving mechanism for moving the web toward the first moving mechanism to form a loop of paper upstream from the first moving mechanism so as to allow the first moving mechanism to move the web into the web cutter via the loop, and operating the second moving mechanism in a further motion cycle in coordination with the start-and-stop motion cycle, the further motion cycle having a second acceleration less than the cutter acceleration and a second deceleration less than the cutter deceleration.

2. The method of claim 1, wherein the first moving mechanism moves the web into the web cutter along a first plane, and the second moving mechanism moves the web toward the first moving mechanism along a second plane different from the first plane.

3. The method of claim 2, wherein the first plane is a horizontal plane, and the second moving mechanism is disposed below the first plane so as to move the web toward the first moving mechanism from a point below the first plane.

4. The method of claim 3, wherein the second plane is substantially a vertical plane.

5. The method of claim 1, wherein the further motion cycle having a further starting paint substantially coincident with a starting point of the start-and-stop motion cycle.

6. The method of claim 5, wherein the second moving mechanism has a minimum speed when it is at the further starting point.

7. The method of claim 6, wherein the minimum speed is zero.

8. The method of claim 6, wherein the minimum speed is greater than zero.

9. The method of claim 1, wherein the loop of paper is substantially used up after the second deceleration of the further motion cycle.

10. The method of claim 1, wherein some of the loop of paper remains after the second deceleration of the further motion cycle.

11. The method of claim 1, wherein the second moving mechanism and the first moving mechanism are spaced within a distance smaller than a sheet length.

12. The method of claim 1, wherein the second deceleration in the further motion cycle is immediately followed by the second acceleration in a next further motion cycle.

13. The method of claim 1, further comprising the step of disposing a third moving mechanism upstream from the second moving mechanism for moving the web toward the second moving mechanism, such that a further loop of paper is formed upstream from the second moving mechanism so as to allow the second moving mechanism to move the web toward the first moving mechanism via the further loop.

14. A web cutting system for moving a web of paper from an upstream paper source and for cutting the web into sheets, said web cutting system comprising:

a cutting mechanism;

a first moving mechanism, positioned upstream from the cutting mechanism, for moving the web of paper past the cutting mechanism, wherein the first moving mechanism operates in a start-and-stop motion cycle, the stop-and-start motion cycle having a stop period to allow the cutting mechanism to cut a length of the leading portion, an acceleration period during which the first moving mechanism accelerates from a stationary state to a predetermined velocity at a cutter acceleration in order to move a length of the web downstream from the cutting mechanism for cutting;

a deceleration period during which the first moving mechanism decelerates from the predetermined velocity at a cutter deceleration to the stop period;

a second moving mechanism positioned upstream from the first moving mechanism for moving the web toward the first moving mechanism to form a loop of paper upstream from the first moving mechanism so as to allow the first moving mechanism to move the web via the loop, wherein the second moving mechanism operates in a further motion cycle in coordination with the start-and-stop motion cycle, the further motion cycle having a second acceleration less than the cutter acceleration and a second deceleration less than the cutter deceleration, and a third moving mechanism positioned upstream from the second moving mechanism for moving the web toward the second moving mechanism, such that a further loop of paper is formed between the second moving mechanism and the third moving mechanism so as to allow the second moving mechanism to move the web toward the first moving mechanism via the further loop.

15. The web cutting system of claim 14, wherein the first plane is a horizontal plane, and the second moving mechanism is disposed below the first plane so as to move the web toward the first moving mechanism from a point below the first plane.

16. The web cutting system of claim 14, wherein the further motion cycle has a further starting point substantially coincident with a starting point of the start-and-stop motion cycle.

17. The web cutting system of claim 14, wherein the first moving mechanism and second moving mechanism are spaced within a sheet length of each other.

18. The web cutting system of claim 14, wherein the further motion cycle is coordinated with the stop-and-start motion cycle to form the loop when the first moving mechanism is decelerating or stopped and to shrink the loop when the first moving mechanism is accelerating.

19. The web cutting system of claim 14, wherein substantially all of the loop is taken in by the first moving mechanism during the acceleration period of the start-and-stop motion cycle.

20. The web cutting system of claim 14, wherein the further motion cycle of the second moving mechanism alternates between accelerating and decelerating without stopping.

21. The web cutting system of claim 14, wherein the first moving mechanism moves the web into the web cutter along a first lane and the second moving mechanism moves the web toward the moving mechanism along a second plane different from the first plane.

wherein the second plane is substantially a vertical plane.

* * * * *